US008241462B2

(12) United States Patent
Sakai et al.

(10) Patent No.: US 8,241,462 B2
(45) Date of Patent: Aug. 14, 2012

(54) PAPERMAKING INTERNAL SIZING AGENT AND USE THEREOF

(75) Inventors: Kazunari Sakai, Kakogawa (JP); Takahiro Fujiwara, Kakogawa (JP); Kazushige Inaoka, Kakogawa (JP); Takashi Yamaguchi, Tokyo (JP); Masaki Ito, Tokyo (JP); Yasunobu Ooka, Tokyo (JP)

(73) Assignees: Harima Chemicals, Inc., Hyogo (JP); Nippon Paper Industries Co., Ltd., Tokyo (JP)

( * ) Notice: Subject to any disclaimer, the term of this patent is extended or adjusted under 35 U.S.C. 154(b) by 101 days.

(21) Appl. No.: 12/670,186

(22) PCT Filed: Mar. 6, 2008

(86) PCT No.: PCT/JP2008/054047

§ 371 (c)(1),
(2), (4) Date: Jan. 22, 2010

(87) PCT Pub. No.: WO2009/013913

PCT Pub. Date: Jan. 29, 2009

(65) Prior Publication Data

US 2010/0200185 A1 Aug. 12, 2010

(30) Foreign Application Priority Data

Jul. 26, 2007 (JP) ..... 2007-195085

(51) Int. Cl.

| | |
|---|---|
| ***D21H 17/37*** | (2006.01) |
| ***D21H 17/41*** | (2006.01) |
| ***D21H 17/42*** | (2006.01) |
| ***D21H 17/43*** | (2006.01) |
| ***D21H 17/44*** | (2006.01) |
| ***D21H 17/45*** | (2006.01) |

(52) U.S. Cl. ..... 162/168.1; 162/168.2; 162/168.3; 526/287; 526/307; 526/307.2; 526/307.6; 526/307.7; 526/310; 526/317.1; 526/318; 526/319; 526/328.5; 526/346

(58) Field of Classification Search .... 162/164.1–164.7, 162/168.1–168.7; 526/287, 307, 307.2, 307.6, 526/307.7, 310, 317.1, 318, 319, 328.5, 346
See application file for complete search history.

(56) References Cited

U.S. PATENT DOCUMENTS

| | | | | |
|---|---|---|---|---|
| 2,964,445 | A | 12/1960 | Daniel et al. | |
| 4,091,165 | A * | 5/1978 | Hayama | 428/409 |
| 4,251,651 | A * | 2/1981 | Kawakami et al. | 526/204 |
| 4,305,860 | A * | 12/1981 | Iovine et al. | 162/164.5 |
| 5,518,585 | A * | 5/1996 | Huth et al. | 162/168.2 |
| 2002/0053413 | A1 * | 5/2002 | Zhang et al. | 162/168.1 |

FOREIGN PATENT DOCUMENTS

| | | |
|---|---|---|
| CA | 2 390 353 | 5/2002 |
| JP | 48-11407 | 2/1973 |
| JP | 58-120895 | 7/1983 |
| JP | 03-167397 | 7/1991 |
| JP | 08-041798 | 2/1996 |
| JP | 09-111094 | 4/1997 |
| JP | 2001-073292 | 3/2001 |
| JP | 2001-073296 | 3/2001 |
| JP | 2003-212539 | 7/2003 |
| JP | 2005-154966 | 6/2005 |
| JP | 2005-219945 | 8/2005 |

* cited by examiner

*Primary Examiner* — Eric Hug
*Assistant Examiner* — Peter Chin
(74) *Attorney, Agent, or Firm* — Clark & Brody

(57) ABSTRACT

To provide a papermaking internal sizing agent capable of efficiently imparting sizing performance even in neutral papermaking which uses calcium carbonate as filler, and uses no aluminum sulfate or uses a small amount of aluminum sulfate, and also provide a paper or a paperboard obtained by using the papermaking internal sizing agent. The papermaking internal sizing agent comprises as an effective ingredient an amphoteric copolymer having hydrophobic groups and cationic groups, at least a part of the cationic groups being quaternized. Preferably, the amphoteric copolymer is obtained by polymerizing monomer ingredients that it essentially contain a hydrophobic monomer (A), a cationic monomer (B), and an anionic monomer (C) and that an anion equivalent of the monomer (C) is 0.1 to 90% of a cation equivalent of the monomer (B), in which a rate of quaternizing of the cationic groups is not less than 40% by mole. The paper or the paperboard contains the above papermaking internal sizing agent.

11 Claims, No Drawings

PAPERMAKING INTERNAL SIZING AGENT AND USE THEREOF

TECHNICAL FIELD

The present invention relates to an internal sizing agent used in papermaking process. More particularly, the present invention relates to a papermaking internal sizing agent capable of efficiently imparting sizing performance even to neutral papermaking for which it is difficult to achieve sufficient effect with a conventional internal sizing agent, and relates to a paper or a paperboard obtained by using the paper making internal sizing agent.

BACKGROUND ART

The neutral papermaking can retain paper strength more than acid papermaking, making it possible to extend the time to use felt or wire during papermaking. Hence there are the following advantages that the drainage of web is improved and formation is improved thereby to improve paper quality. Unlike the acid papermaking, the neutral papermaking has fewer problems with paper deterioration and drainage regulation, and is advantageous in terms of water recycling.

Conventionally, the sizing agent composed of alkyl ketene dimer has been known as the sizing agent used in the neutral papermaking. However, the alkyl ketene dimer-based sizing agent has the disadvantage that the sizing effect immediately after papermaking is poor due to a slow rise of the sizing effect. Additionally, there has been the problem that the alkyl ketene dimer-based sizing agent is generally expensive and thus increases costs. Although the neutral rosin sizing agent using rosin ester or reinforced rosin ester has also been known, the neutral rosin sizing agent has the problem that it is difficult to obtain the initial degree of sizing unless papermaking conditions are properly controlled when using the sizing agent. The neutral rosin sizing agent also has the problem that due to its low sizing performance, there is need to increase the addition rate of the sizing agent, thus increasing sizing costs.

Heretofore, as a sizing agent usable in the neutral papermaking, the sizing agent composed of the quaternized form of hydrophobic-group-containing cationic polymer obtained by quaternizing a copolymer composed of a styrene homologue and aminoalkyl ester of (meth)acrylic acid with alkyl halide has been proposed (refer to patent document 1). Other sizing agent, which is adapted to improve not only sizing effect but also the strength and the friction coefficient of paper by optimizing the kind of the quaternizing agent and the kind of the cationic monomer used in the above sizing agent, is also known. Specifically, there has been proposed the sizing agent composed of the quaternized form of hydrophobic-group-containing cationic polymer obtained by quaternizing the above copolymer with epihalohydrin instead of alkyl halide (refer to patent document 2), and the sizing agent composed of a copolymer whose constituting monomer is styrenes and aminoalkyl ester of (meth)acrylic acid, amino acrylamide of (meth)acrylic acid, or quaternary salts thereof (refer to patent document 3). These sizing agents are cationic and hence self-fixed onto anionic chargeable pulp fibers thereby to impart sizing performance to papers without using any fixing agent such as aluminum sulfate, thereby enabling neutral papermaking or alkaline papermaking.

With the aim of further improving sizing effect, there has been proposed the sizing agent composed of rosin-bonding cationic polymer obtained by allowing a predetermined amount of rosin derivative to coexist during the copolymerization of a hydrophobic monomer and a cationic monomer (refer to patent document 4). This sizing agent enables the bulky structure of the rosin incorporated into polymer to impart high hydrophobicity after the fixing onto pulp fibers. Additionally, owing to the interaction between the carboxyl groups of a rosin ring and calcium carbonate, the polymer itself becomes insoluble, and the fixing through cationic groups is further facilitated, thereby permitting a considerable improvement in sizing effect.

Patent document 1: U.S. Pat. No. 2,964,445

Patent document 2: Japanese Unexamined Patent Application Publication No. 48-11407

Patent document 3: Japanese Unexamined Patent Application Publication No. 3-167397

Patent document 4: Japanese Unexamined Patent Application Publication No. 2001-73292

DISCLOSURE OF THE INVENTION

Problems to be Solved by the Invention

However, there is significant room for improvements in the cationic sizing agents of the patent documents 1 to 3, in terms of fixing properties onto pulp fibers and hydrophobilization after fixing in the neutral papermaking or the alkaline papermaking using a large amount of calcium carbonate as filler. Therefore, a fully satisfactory sizing effect remains unachievable. On the other hand, the sizing agent of the patent document 4 has the disadvantage that the molecular weight of the rosin-bonding cationic polymer is susceptible to the influence of the amount of rosin addition, and hence the self-fixing capability of this polymer onto the pulp, namely the sizing effect thereof is likely to depend on the amount of rosin addition. Also in the sizing agent of the patent document 4, if the amount of rosin incorporation into the polymer of the main chain is small, or if the unreacted rosin remains, the polymer ingredients contributing to hydrophobilization by the interaction with calcium carbonate may be decreased, and the exhibition of sizing effect may become insufficient.

Additionally, the conventional cationic sizing agents including each of the sizing agents of the patent documents 1 to 4 might also cause interaction with various kinds of anionic substances existing within the actual papermaking system, so-called anionic trash. In this case, there is also the problem that the self-fixing onto the pulp fibers is hindered, making it difficult to effectively exhibit the sizing performance. Particularly, this problem becomes significant in the neutral papermaking using a small amount of aluminum sulfate because the anionic trash amount tends to increase.

Therefore, an advantage of the present invention is to provide a papermaking internal sizing agent capable of efficiently imparting the sizing performance even in the neutral papermaking which uses calcium carbonate as filler, and uses no aluminum sulfate or uses a small amount of aluminum sulfate, and also provide a papers or a paperboard obtained by using the papermaking internal sizing agent.

Means for Solving the Problems

The present inventors made tremendous research efforts for solving the above problems and found out that these problems could be solved by using, as an internal sizing agent, an amphoteric copolymer having hydrophobic groups and cationic groups, at least a part of the cationic groups being quaternized.

Specifically, based on the commonly accepted theory that it becomes difficult to impart hydrophobic properties to papers under papermaking conditions in which calcium carbonate exists and no aluminum sulfate exists or the amount of aluminum sulfate used is small, the present inventors repeated a series of experiments with the aim of efficiently incorporating and distributing portions, which can be hydrophobilized by the interaction with calcium carbonate, into a hydrophobic polymer constituting main chain. They focused on the facts that in general, the water-dispersed matter of calcium carbonate has different particle surface charges depending on the diluted situation and pH thereof, and that an anionic polymer may be added to improve the dispersibility of calcium carbonate particles. Consequently, they considered that as a functional group to be interacted with calcium carbonate, an anionic group such as a carboxyl group might be effective when the calcium carbonate has a positive charge, and a cationic group such as an amino group and an ammonium group might be effective when it has a negative charge. Then, they found out that even in the neutral papermaking under conditions in which calcium carbonate exists, and no aluminum sulfate exists or the amount of aluminum sulfate used is small, excellent size performance could be efficiently imparted by incorporating amphoteric portions interacted with calcium carbonates in all surface charge states by allowing both a cationic monomer and an anionic monomer, which are liable to be copolymerized with a monomer having a hydrophobic portion such as styrene or (meth) acrylate having an alkyl group, to be copolymerized with the monomer. They also found out that the polymer design having the above amphoteric properties enables a reduction in the interaction with the anionic trash existing within the papermaking system, and further this polymer design achieves an easy control of the molecular weight of the copolymer. The present invention has been completed based on these findings.

That is, the papermaking internal sizing agent of the invention comprises as an effective ingredient the amphoteric copolymer having hydrophobic groups and cationic groups, at least a part of the cationic groups being quaternized.

The paper or the paperboard of the invention contains the above papermaking internal sizing agent of the invention.

In the present specification, the term "(meth)acrylic acid" is a general term for "acrylic acid" or "methacrylic acid." Similarly, the term "(meth) acryl" means "acryl" or "methacryl." The term "(meth) acrylo" means "acrylo" or "methacrylo." The term "(meth)acrylate" means "acrylate" or "methacrylate." The term "(meth) allyl" means "allyl" or "methallyl."

Effect of the Invention

The present invention is capable of efficiently imparting the sizing performance even in the neutral papermaking that uses calcium carbonate as filler, and uses no aluminum sulfate or uses a small amount of aluminum sulfate. Further, the papermaking internal sizing agent of the invention has less interaction with the anionic trash existing within the actual papermaking system, and hence it is expected to satisfactorily self-fix onto pulp fibers and effectively exhibit sizing performance. Naturally, the papermaking internal sizing agent of the invention is capable of exhibiting excellent sizing performance in acid papermaking or alkaline papermaking.

BEST MODE FOR CARRYING OUT THE INVENTION

The papermaking internal sizing agent of the invention comprises as an effective ingredient the amphoteric copolymer having hydrophobic groups and cationic groups, at least a part of the cationic groups being quaternized. This enables efficient imparting of sizing performance even in the neutral papermaking that uses calcium carbonate as filler, and uses no aluminum sulfate or uses a small amount of aluminum sulfate. Further, owing to less interaction with the anionic trash existing within the actual papermaking system, it is expected to satisfactorily self-fix onto pulp fibers and effectively exhibit sizing performance. Thus, the papermaking internal sizing agent of the invention is capable of extremely efficiently exhibiting excellent sizing performance in the neutral papermaking conditions in which the amount of calcium carbonate and the amount of anionic trash are large. Hence it is expected that the usefulness thereof is increasingly enhanced under the papermaking conditions where there is a trend towards neutralization.

The reason why the amphoteric copolymer exhibits the above effect seems that the amphoteric copolymer has within a polymer molecule a portion that self fixes onto pulp and also interacts with calcium carbonate, and the amphoteric copolymer is capable of forming an ionic complex within the polymer and between the polymers. That is, it seems that efficient hydrophobilization of the pulp and calcium carbonate becomes possible by having the above portion within a molecule, and the formation of the ionic complex makes it possible to have a huge molecular assembly structure and, as a result, the physical retention improvement with respect to pulp fibers, and the self fixing capability improvement owing to relaxed interaction with the anionic trash and the like are achieved, thus enabling effective sizing exhibition.

The amphoteric copolymer is preferably obtained by polymerizing monomer ingredients composed essentially of a hydrophobic monomer (A), a cationic monomer (B), and an anionic monomer (C). This amphoteric copolymer has hydrophobic groups derived from the hydrophobic monomer (A), cationic groups derived from the cationic monomer (B), and anionic groups derived from the anionic monomer (C).

As the hydrophobic monomer (A), at least one kind selected from the group consisting of styrenes and C1 to C14 alkyl esters of (meth)acrylic acid (:the esters of alkyl having a carbon number of 1 to 14) is suitably used, without being limited thereto. For example, (meth) acrylonitrile is usable. Only one kind, or two or more kinds of the hydrophobic monomer (A) may be used.

Examples of the styrenes include styrene, α-methylstyrene, vinyl toluene, ethyl vinyl toluene, chloromethyl styrene, and vinyl pyridine. Among others, styrene is preferred.

Examples of the C1-C14 alkyl esters of (meth)acrylic acid include aliphatic hydrocarbon esters such as methyl(meth) acrylate, ethyl(meth)acrylate, propyl(meth)acrylate, n-butyl (meth)acrylate, iso-butyl(meth)acrylate, t-butyl(meth)acrylate, cyclohexyl(meth)acrylate, benzyl(meth)acrylate, 2-ethylhexyl(meth)acrylate, and lauryl(meth)acrylate. There are also (meth)acrylic acid esters containing alicyclic or aromatic hydrocarbon groups. Among others, methyl(meth) acrylate, butyl(meth)acrylate, iso-butyl(meth)acrylate, 2-ethylhexyl(meth)acrylate and lauryl(meth)acrylate are preferred.

As the cationic monomer (B), at least one kind selected from (meth)acrylamide containing tertiary amino groups and (meth)acrylate containing tertiary amino groups is suitably used, without being limited thereto. It is also possible to use, for example, cationic monomers such as (meth) acrylamides containing a primary or secondary amino group, (meth)acrylates containing a primary or secondary amino group, (meth) acrylamide containing a quaternary ammonium salt group, (meth)acrylate containing a quaternary ammonium salt group, and diaryl dialkyl ammonium halide. Only one kind, or two or more kinds of the cationic monomers (B) may be used.

Examples of the (meth)acrylamide containing a tertiary amino group include dialkylaminoalkyl(meth)acrylamides such as dimethylaminoethyl(meth)acrylamide, dimethylaminopropyl-(meth)acrylamide, diethylaminoethyl(meth)acrylamide and diethylaminopropyl(meth)acrylamide.

Examples of the (meth)acrylate containing a tertiary amino group include dialkylaminoalkyl(meth)acrylates such as dimethylaminoethyl(meth)acrylate, dimethylaminopropyl-(meth)acrylate, diethylaminoethyl(meth)acrylate and diethylaminopropyl(meth)acrylate.

Examples of the (meth)acrylamides containing a primary or secondary amino group include (meth)acrylamides containing a primary amino group such as aminoethyl(meth) acrylamide; and (meth)acrylamides containing a secondary amino group such as methylaminoethyl(meth) acrylamide, ethylaminoethyl-(meth) acrylamide, and t-butylaminoethyl (meth)acrylamide.

Examples of the (meth)acrylates containing a primary or secondary amino group include (meth)acrylate containing a primary amino group such as aminoethyl(meth)acrylate; and (meth)acrylates containing a secondary amino group such as methylaminoethyl(meth)acrylate, ethylaminoethyl(meth)-acrylate, and t-butylaminoethyl(meth)acrylate.

Examples of the (meth)acrylamides containing a quaternary ammonium salt group and the (meth)acrylate containing a quaternary ammonium salt group include monomers containing a mono-quaternary salt group obtained by quaternizing the above (meth)acrylamide containing a tertiary amino group or the above (meth)acrylate containing a tertiary amino group with a quaternizing agent (for example, methyl chloride, benzyl chloride, methyl sulfate, and epichlorohydrin). There are, for example, acrylamide propyl trimethyl ammonium chloride, acrylamide propyl benzyl dimethyl ammonium chloride, methacryloyloxyethyl dimethyl benzyl ammonium chloride, acryloyloxyethyl dimethyl benzyl ammonium chloride, (meth)acryloyl aminoethyl trimethyl ammonium chloride, (meth)acryloyl aminoethyl triethyl ammonium chloride, (meth)acryloyloxyethyl trimethyl ammonium chloride, and (meth) acryloyloxyethyl triethyl ammonium chloride.

As the anionic monomer (C), at least one kind selected from the group consisting of α, β-unsaturated carboxylic acids and α, β-unsaturated sulfonic acids is suitably used, without being limited thereto. Only one kind, or two or more kinds of the anionic monomers (C) may be used.

Examples of the α, β-unsaturated carboxylic acids include (meth)acrylic acid, maleic acid, maleic anhydride, fumaric acid, itaconic acid, citraconic acid, citraconic anhydride, and salts thereof (sodium salt, potassium salt, and ammonium salt).

Examples of the α, β-unsaturated sulfonic acids include vinyl sulfonic acid, (meth) allyl sulfonic acid, styrene sulfonic acid, sulfopropyl(meth)acrylate, 2-(meth)acrylamide-2-methylpropane sulfonic acid, and salts thereof (sodium salt, potassium salt, and ammonium salt).

In the monomer ingredients, the anion equivalent of the anionic monomer (C) is preferably 0.1 to 90%, more preferably 5 to 50%, even more preferably 5 to 20% of the cation equivalent of the cationic monomer (B). That is, the amphoteric copolymer produced by polymerizing the monomer ingredients have more cation equivalent and less anion equivalent, thus making it easy to exhibit sizing effect. When the cation equivalent has an approximate or the same value as the anion equivalent, or when the cation equivalent is smaller than the anion equivalent (specifically, when the ratio (percentage) of the anion equivalent to the cation equivalent exceeds 90%), the anionic portions and the cationic portions of the copolymer are too strongly ionically interacted with each other, thereby decreasing active ionic groups. This causes deterioration of the fixing action of the cation onto pulp fibers, or a poor balance between hydrophobic portions and hydrophilic portions. As a result, there is a tendency to hinder efficient sizing performance exhibition.

Like the ratio of the anion equivalent to the cation equivalent in the monomer ingredients, the ratio of the anion equivalent to the cation equivalent in the amphoteric copolymer produced by polymerizing the monomer ingredients is therefore preferably within the same range as described above. For example, when monomer ingredients are selected so that the polymerization of the monomer ingredients is carried out through vinyl bonding, namely when the cationic groups and the anionic groups do not participate in the polymerization, the ratio of the anion equivalent to the cation equivalent in the amphoteric copolymer coincides with the ratio of the anion equivalent to the cation equivalent in the monomer ingredients.

The content ratio of the individual essential monomers in the above monomer ingredients are preferably set so that the ratio of the anion equivalent of the anionic monomer (C) to the cation equivalent of the cationic monomer (B) falls within the above range, but otherwise there are no specific limitations. For example, it is preferable that the hydrophobic monomer (A) be approximately 60 to 90% by weight, the cationic monomer (B) be approximately 10 to 40% by weight, and the anionic monomer (C) be approximately 1 to 10% by weight, with respect to the overall amount of the monomer ingredients.

The monomer ingredients may further contain, as required, other monomers, besides the above hydrophobic monomer (A), the above cationic monomer (B) and the above anionic monomer (C), unless the effect of the invention is impaired. Examples of the above other monomers include (meth)acrylates containing no amino group and containing a hydroxyl group, such as hydroxyethyl(meth)acrylate and hydroxypropyl(meth)acrylate; monomers containing no amino group and containing an amide group, such as (meth) acrylamide, dimethyl(meth)acrylamide, diethyl(meth)acrylamide, and isopropyl(meth) acrylamide; vinyl acetate, vinyl propionate, and methyl vinyl ether. Only one kind or a combination of two or more kinds of these other monomers may be used.

There are no specific limitations imposed on the polymerization of the above monomer ingredients, and any known polymerization method such as bulk polymerization, solution polymerization, or emulsion polymerization may be employed. The making methods of the individual monomers and initiators may also be suitably selected from any known methods such as batch, division, partial, and full drops. The medium (solvent) during the polymerization may also be selected from known ones, depending on the polymerization method or the like.

There are no specific limitations imposed on the polymerization initiator usable for the above polymerization. For example, an azo-based polymerization initiator, a peroxide-based polymerization initiator, or other initiator may be suitably selected. Alternatively, redox initiator jointly using peroxide and a reducing agent may be used. Only one kind or a combination of two or more kinds of the polymerization initiators may be used. There are no specific limitations imposed on the amount of the polymerization initiator used, and it may be suitably set.

Examples of the azo-based polymerization initiator include azobismethylbutyronitrile, dimethyl azobisisobutyrate, azobisdimethyl valeronitrile, azobisisobutyronitrile, and azobis-2-amidinopropane dihydrochloride.

Examples of the peroxide-based polymerization initiator include organic peroxides such as benzoyl persulfate, t-butyl peroxybenzoate, t-butylperoxy isopropyl monocarbonate, t-butylperoxy-2-ethylhexanoate and cumene hydroperoxide; and inorganic peroxides such as hydrogen peroxide, ammonium peroxodisulfate and potassium peroxodisulfate.

As the redox initiator, for example, the above-mentioned peroxide and a reducing agent such as sodium sulfite, iron(II) sulfate, iron(II) chloride, or tertiary amines may be used together.

In order to achieve a smooth reaction while preventing viscosity increase, the above polymerization can also be carried out in the presence of a chain transfer agent as required. The chain transfer agent may be suitably selected from oil-soluble or water-soluble chain transfer agents. In general, the oil-soluble chain transfer agent is preferred when the polymerization is carried out in a lipophilic organic solvent. On the other hand, the water-soluble chain transfer agent is preferred when the polymerization is carried out in a hydrophilic organic solvent. Alternatively, the oil-soluble chain transfer agent and the water-soluble chain transfer agent may be used together. Only one kind or a combination of two or more kinds of the chain transfer agents may be used. There are no specific limitations imposed on the amount of the chain transfer agent used, but it is preferable to use, for example, approximately 1 to 5% by weight to the overall amount of the monomer ingredients.

Examples of the oil-soluble chain transfer agent include mercaptans such as t-dodecyl mercaptan, n-dodecyl mercaptan, n-octyl mercaptan, and dodecyl mercaptopropionate; hydrophobic allyl compounds such as (meth) allyl methacrylate; cumene, carbon tetrachloride, α-methylstyrene dimer, and terpinolene.

Examples of the water-soluble chain transfer agent include mercaptans such as mercaptethanol, thioglycerol, thiomalic acid, thioglycol acid, and salts thereof; hydrophilic allyl compounds such as (meth)allyl alcohol, (meth)allyl amine, (meth)allylsulfonic acid, and salts thereof; ethanol amine, and isopropyl alcohol.

At least a part of the cationic groups of the amphoteric copolymer is quaternized, and the rate of quaternizing of the cationic groups of the amphoteric copolymer is preferably not less than 40% by mole, more preferably 50 to 100% by mole. If the rate of quaternizing is less than 40% by mole, efficient hydrophobic property imparting effect onto pulp fibers and the filler (calcium carbonate) might not be obtained when the papermaking pH is high.

When quaternizing the cationic groups of the amphoteric copolymer, the copolymer obtained after polymerizing the above monomer ingredients may be quaternized with a quaternizing agent, or the polymerization may be carried out by using a monomer containing a quaternary ammonium group as the cationic monomer (B) of the above monomer ingredients.

As the quaternizing agent usable for quaternization, one kind or two or more kinds may be selected from dimethyl sulfate, dimethyl carbonate, methyl chloride, allyl chloride, benzyl chloride, propylene oxide, butylene oxide, styrene oxide, epichlorohydrin, epibromohydrin, ethylene chlorohydrin, 3-chloro-1,2-propanediol, 3-chloro-2-hydroxypropyltrimethyl ammonium chloride, glycidol, butyl glycidyl ether, allyl glycidyl ether, and glycidyl methacrylate. Among others, epichlorohydrin and benzyl chloride are preferred.

The weight average molecular weight of the amphoteric copolymer is preferably 10,000 to 1,000,000, more preferably 30,000 to 600,000. If the weight average molecular weight thereof is less than 10,000, the retention of the sizing agent is remarkably lowered, and there is a tendency to make it difficult to obtain sizing effect. On the other hand, if it exceeds 1,000,000, the sizing agent is not efficiently diffused into paper in the drying step of papermaking, so that the sizing agent ingredients might exist nonuniformly in the paper thereby to deteriorate the sizing effect.

The papermaking internal sizing agent of the invention is required to contain the above amphoteric copolymer as an effective ingredient, and it may be, for example, the above amphoteric copolymer itself, or a solution or a dispersion liquid containing the above amphoteric copolymer (for example, the reaction liquid obtained by the above polymerization and quaternization). Alternatively, the papermaking internal sizing agent of the invention may contain, besides the above amphoteric copolymer, a conventionally known additive such as neutral rosin, alkyl ketene dimer (AKD), or alkenyl succinic anhydride (ASA), unless the effect of the invention is impaired.

The paper or the paperboard of the invention contains the papermaking internal sizing agent of the invention. This paper or this paperboard is manufactured by adding the internal sizing agent of the invention into a pulp slurry, followed by wet papermaking. On this occasion, the dosage of the internal sizing agent of the invention is preferably adjusted so that the effective ingredient (the above amphoteric copolymer) is normally 0.05 to 0.30% by weight based on the weight of the pulp.

There are no specific limitations imposed on the pulp fibers constituting the pulp slurry. It is possible to use for example those usually used for papermaking, namely, wood pulps such as NBKP and LBKP; mechanical pulps such as TMP and GP; and deinked pulp (DIP). There are also nonwood pulps such as linter pulp, hemp, bagasse, kenaf, esparto, and straw; semisynthetic fibers such as rayon and acetate; and synthetic fibers such as polyolefin, polyamide and polyester.

It is of course possible to add as required additives such as aluminum sulfate, filler, dye, paper strengthening agent, retention aid and defoaming agent. As filler, any one of known fillers for papermaking can be used. Examples thereof include inorganic fillers such as calcium carbonate, clay, silica, calcium carbonate-silica composite (the precipitated calcium carbonate-silica composite described in, for example, Japanese Unexamined Patent Publications No. 2003-212539 or No. 2005-219945), kaolin, magnesium carbonate, barium carbonate, barium sulfate, aluminum hydroxide, zinc oxide and titanium oxide; organic fillers such as urea-formalin resin, melamine resin, polystyrene resin and phenol resin; regenerated fillers whose raw material is papermaking sludge or deinked flos. These can be used singly or in combination. Preferred filler is calcium carbonate. Alternatively, the existing sizing agents such as neutral rosin, AKD, or ASA can also be used together. The dosage of these additives and the existing sizing agents may be set suitably.

The paper or the paperboard of the invention is particularly preferably neutral papers obtained by neutral papermaking in the interest of effective exhibition of the effect of the invention. Preferably, the paper or the paperboard of the invention is used as neutral high quality papers, printing papers, information papers, newsprint, or the like.

In general, the term "paperboard" denotes especially thick ones among papers. In the present invention, multi-ply ones (multilayer papers) such as corrugated board raw papers, white boards, chipboards, yellow cardboards and carrier tapes are particularly referred to as "paperboards," and single-ply ones are referred to as "papers."

EXAMPLES

The present invention will now be described in details based on the following examples, without being limited thereto.

In the following examples and comparative examples, the weight average molecular weight of copolymers is measured by a gel permeation chromatography under the following conditions.

Columns: "Asahipak GF-7M HQ", "Asahipak GF-310 HQ", each manufactured by Showa Denko K.K.

Instrument: "GPC SYSTEM-21H" manufactured by Showa Denko K.K.

Solvent: dimethylformamide

Example 1-1

Monomer ingredients made up of 30 parts by weight of styrene, 50 parts by weight of butyl acrylate, 15 parts by weight of dimethylaminoethyl methacrylate, 3 parts by weight of dimethylaminopropyl acrylamide, 1 part by weight of methacrylic acid and 1 part by weight of itaconic acid; 2 parts by weight of t-dodecyl mercaptan as a chain transfer agent; and 50 parts by weight of methylisobutyl ketone as a solvent were put into a four-mouth flask and heated to 85° C. Then, 2.5 parts by weight of benzoyl peroxide as an initiator was added thereto and polymerized at 90° C. for three hours. Subsequently, this was water-solubilized by adding 300 parts by weight of water and 7.7 parts by weight of 90% acetic acid aqueous solution, and then heat distilled to distil off the methylisobutyl ketone. Thereafter, 8.5 parts by weight of epichlorohydrin as a quaternizing agent was added thereto at 85° C. and reacted at the same temperature for three hours. Hereat, the reaction solution after the reaction was completely water-solubilized. This was then cooled and diluted with water, thereby obtaining an aqueous solution having a solid content of 20% by weight and containing an amphoteric copolymer having hydrophobic groups. This was employed as the papermaking internal sizing agent (1) of the invention.

Table 1 shows the anion equivalent of the anionic monomer in the used monomer ingredients is represented by the ratio (percentage) to the cation equivalent of the cationic monomer, and also shows the rate of quaternizing of the cationic groups and the weight average molecular weight in the copolymer within the obtained internal sizing agent.

Example 1-2

Monomer ingredients made up of 40 parts by weight of styrene, 40 parts by weight of isobutyl methacrylate, 17 parts by weight of dimethylaminoethyl methacrylate, 2 parts by weight of itaconic acid, and 1 part by weight of acrylic acid; 2 parts by weight of n-dodecyl mercaptan as a chain transfer agent; and 50 parts by weight of toluene as a solvent were put into a four-mouth flask and heated to 105° C. Then, 2.5 parts by weight of t-butyl peroxy isopropyl monocarbonate as an initiator was added thereto and polymerized at 110° C. for three hours. Subsequently, this was water-solubilized by adding 300 parts by weight of water and 7.2 parts by weight of 90% acetic acid aqueous solution, and then heat distilled to distil off the toluene. Thereafter, 10.2 parts by weight of 3-chloro-2-hydroxypropyltrimethyl ammonium chloride as a quaternizing agent was added thereto at 85° C. and reacted at the same temperature for three hours. This was then cooled and diluted with water, thereby obtaining a slight turbid aqueous solution having a solid content of 20% by weight and containing an amphoteric copolymer having hydrophobic groups. This was employed as the papermaking internal sizing agent (2) of the invention.

Table 1 shows the anion equivalent of the anionic monomer in the used monomer ingredients is represented by the ratio (percentage) to the cation equivalent of the cationic monomer, and also shows the rate of quaternizing of the cationic groups and the weight average molecular weight in the copolymer within the obtained internal sizing agent.

Example 1-3

Monomer ingredients made up of 50 parts by weight of styrene, 26 parts by weight of butyl methacrylate, 15 parts by weight of dimethylaminoethyl methacrylate, 6 parts by weight of dimethylaminopropyl acrylamide, 1 part by weight of methacrylic acid, 1 part by weight of acrylic acid, and 1 part by weight of maleic anhydride; 1.5 parts by weight of thioglycolic acid as a chain transfer agent; and 50 parts by weight of isopropanol as a solvent were put into a four-mouth flask and heated to 85° C. Then, 2.5 parts by weight of 2,2-azobisisobutylonitrile as an initiator was added thereto and polymerized at 90° C. for three hours. Subsequently, this was water-solubilized by adding 300 parts by weight of water and 9 parts by weight of 90% acetic acid aqueous solution, and then heat distilled to distil off the isopropanol. Thereafter, 13.5 parts by weight of dimethyl sulfate as a quaternizing agent was added thereto at 85° C. and reacted at the same temperature for three hours. Hereat, the reaction solution after the reaction was completely water-solubilized. This was then cooled and diluted with water, thereby obtaining an aqueous solution having a solid content of 20% by weight and containing an amphoteric copolymer having hydrophobic groups. This was employed as the papermaking internal sizing agent (3) of the invention.

Table 1 shows the anion equivalent of the anionic monomer in the used monomer ingredients is represented by the ratio (percentage) to the cation equivalent of the cationic monomer, and also shows the rate of quaternizing of the cationic groups and the weight average molecular weight in the copolymer within the obtained internal sizing agent.

Examples 1-4 to 1-8

By performing the same procedure as Example 1-1, except that the kind and the amount of monomer ingredients and the kind and the amount of the quaternizing agent were changed as shown in Table 1, aqueous solutions or slight turbid aqueous solutions having a solid content of 20% by weight and containing an amphoteric copolymer having hydrophobic groups were obtained, and they were employed as the papermaking internal sizing agents (4) to (8) of the invention, respectively.

Table 1 shows the anion equivalent of the anionic monomer in the used monomer ingredients is represented by the ratio (percentage) to the cation equivalent of the cationic monomer, and also shows their respective rates of quaternizing of the cationic groups and their respective weight average molecular weights in the copolymers within the obtained internal sizing agents.

Example 1-9

Monomer ingredients made up of 30 parts by weight of styrene, 50 parts by weight of butyl acrylate, 19 parts by weight of dimethylaminoethyl methacrylate, and 1 part by weight of methacrylic acid; 0.2 parts by weight of n-dodecyl mercaptan as a chain transfer agent; and 50 parts by weight of methylisobutyl ketone as a solvent were put into a four-mouth flask and heated to 85° C. Then, 2.0 parts by weight of benzoyl peroxide as an initiator was added thereto and polymerized at 90° C. for three hours. Subsequently, this was water-solubilized by adding 300 parts by weight of water and 8.1 parts by weight of 90% acetic acid aqueous solution, and then heat distilled to distil off the methylisobutyl ketone. Thereafter, 9.0 parts by weight of epichlorohydrin as a quaternizing agent was added thereto at 85° C. and reacted at the same temperature for three hours. Hereat, the reaction solution after the reaction was completely water-solubilized. This was then cooled and diluted with water, thereby obtaining an aqueous solution having a solid content of 15% by weight and containing an amphoteric copolymer having hydrophobic groups. This was employed as the papermaking internal sizing agent (9) of the invention.

Table 1 shows the anion equivalent of the anionic monomer in the used monomer ingredients is represented by the ratio (percentage) to the cation equivalent of the cationic monomer, and also shows the rate of quaternizing of the cationic group and the weight average molecular weight in the copolymer within the obtained internal sizing agent.

Comparative Example 1-1

As solvents, 50 parts by weight of isopropanol and 8.5 parts by weight of 90% acetic acid aqueous solution were put into a four-mouth flask and heated to 85° C. while stirring. The total amount of a mixed solution in which 2 parts by weight of n-dodecyl mercaptan as a chain transfer agent and 2 parts by weight of t-butylperoxy-2-ethylhexanoate as an initiator were previously dissolved in monomer ingredients made up of 30 parts by weight of styrene, 50 parts by weight of butyl acrylate and 20 parts by weight of dimethylaminoethyl methacrylate, were added dropwise into the flask for three hours, while retaining the temperature in the flask at 80 to 90° C., and matured at 80 to 90° C. for one hour, thereby completing polymerization. Subsequently, 300 parts by weight of hot water was added into the flask, while retaining the temperature in the flask at 80° C., and then heat distilled to distil off the isopropanol. Thereafter, 9.5 parts by weight of epichlorohydrin as a quaternizing agent was added at 85° C. and reacted at the same temperature for three hours. Hereat, the reaction solution after the reaction was completely water-solubilized. This was then cooled and diluted with water, thereby obtaining an aqueous solution having a solid content of 20% by weight and containing a cationic copolymer having hydrophobic groups. This was employed as an internal sizing agent (C1) for comparison.

The rate of quaternizing of the cationic groups and the weight average molecular weight in the copolymer within the obtained internal sizing agent are shown in Table 1.

Comparative Example 1-2

Monomer ingredients made up of 30 parts by weight of styrene, 50 parts by weight of butyl acrylate, and 20 parts by weight of dimethylaminoethyl methacrylate; 10 parts by weight of tall oil rosin; 3 parts by weight of α-methylstyrene dimer as a chain transfer agent; and 40 parts by weight of toluene as a solvent were put into a four-mouth flask and heated to 85° C. Then, 2.5 parts by weight of 1,1'-azobis-(cyclohexane-1-carbonitrile) as an initiator was added thereto and polymerized at 90° C. for three hours. Subsequently, this was water-solubilized by adding 300 parts by weight of water and 8.5 parts by weight of 90% acetic acid aqueous solution, and then heat distilled to distil off the toluene. Thereafter, 9.5 parts by weight of epichlorohydrin as a quaternizing agent was added thereto at 85° C. and reacted at the same temperature for three hours. Hereat, the reaction solution after the reaction was completely water-solubilized. This was then cooled and diluted with water, thereby obtaining an aqueous solution having a solid content of 20% by weight and containing a cationic copolymer having rosin-bonding type hydrophobic groups. This was employed as an internal sizing agent (C2) for comparison.

The rate of quaternizing of the cationic groups and the weight average molecular weight in the copolymer within the obtained internal sizing agent are shown in Table 1.

Comparative Examples 1-3 and 1-4

By performing the same procedure as Comparative Example 1-1, except that the kind and the amount of monomer ingredients and the kind and the amount of the quaternizing agent were changed as shown in Table 1 (However, in the Comparative Example 1-3, the quaternizing agent is unused), an aqueous solution or a slight turbid aqueous solution having a solid content of 20% by weight and containing a cationic copolymer having hydrophobic groups were obtained, which were employed as internal sizing agents (C3) and (C4) for comparison, respectively.

Their respective rates of quaternizing of the cationic groups and their respective weight average molecular weights in the copolymers within the obtained internal sizing agents are shown in Table 1.

Comparative Example 1-5

Monomer ingredients made up of 77 parts by weight of styrene, 10 parts by weight of methacrylic acid and 13 parts by weight of acrylic acid; 2.5 parts by weight of n-dodecyl mercaptan as a chain transfer agent; and 45 parts by weight of isopropanol as a solvent were put into a four-mouth flask and heated to 85° C. Then, 2 parts by weight of t-butyl peroxyethylhexanoate as an initiator was added thereto and polymerized at 85° C. for three hours. Subsequently, this was heat distilled to distil off the isopropanol. Thereafter, 22 parts by weight of 25% aqueous ammonia and 300 parts by weight of water were added thereto at 80° C. and held the same temperature for one hour. Hereat, the reaction solution after holding for one hour was completely water-solubilized. This was then cooled and diluted with water, thereby obtaining an aqueous solution having a solid content of 20% by weight and containing an anionic copolymer having hydrophobic groups. This was employed as an internal sizing agent (C5) for comparison.

The weight average molecular weight of the copolymer within the obtained internal sizing agent is shown in Table 1.

The following abbreviations are used in Table 1.

| | |
|---|---|
| ST: | styrene |
| MMA: | methyl methacrylate |
| BMA: | butyl methacrylate |
| IBMA: | isobutyl methacrylate |
| BA: | butyl acrylate |
| DM: | dimethylaminoethyl methacrylate |
| DMC: | methacryloyloxyethyl trimethyl ammonium chloride |
| DMAPAA: | dimethylaminopropyl acrylamide |
| MAA: | methacrylic acid |
| IA: | itaconic acid |
| AA: | acrylic acid |
| MA: | maleic anhydride |
| EPC1: | epichlorohydrin |
| CTA: | 3-chloro-2-hydroxypropyltrimethyl ammonium chloride |
| DMS: | dimethyl sulfate |
| BCL: | benzyl chloride |

TABLE 1

| | Monomer ingredients | | | | | | | | | | | | Ratio of anion equivalent* | Quaternizing agent | | Rate of quarternizing | weight average molecular weight × |
|---|---|---|---|---|---|---|---|---|---|---|---|---|---|---|---|---|---|
| | Hydrophobic monomer (Parts by weight) | | | | | Cationic monomer (Parts by weight) | | | Anionic monomer (Parts by weight) | | | | | | Amount (Parts by | | |
| | ST | MMA | BMA | IBMA | BA | DM | DMC | DMAPAA | MAA | IA | AA | MA | (%) | Kind | weight) | (% by mole) | $10^4$ |
| Example 1-1 | 30 | | | | 50 | 15 | | 3 | 1 | 1 | | | 24 | EPCI | 8.5 | 80 | 26 |
| Example 1-2 | 40 | | | 40 | | 17 | | | | 2 | 1 | | 41 | CTA | 10.2 | 50 | 21 |
| Example 1-3 | 50 | | 26 | | | 15 | | 6 | 1 | | 1 | 1 | 34 | DMS | 13.5 | 80 | 35 |
| Example 1-4 | 47 | 26 | | | | 11 | | 11 | 3 | 1 | | 1 | 50 | EPCI | 10.5 | 80 | 9 |
| Example 1-5 | 36 | | | 40 | | 5 | | 17 | 2 | | | | 17 | BCL | 12.5 | 70 | 45 |
| Example 1-6 | | 25 | 20 | 28 | | | | 25 | | 2 | | | 19 | EPCI | 13.4 | 90 | 56 |
| Example 1-7 | 20 | 20 | 10 | 20 | | 25 | 2 | | | 1 | 1 | 1 | 29 | EPCI | 12.6 | 85 | 18 |
| Example 1-8 | | | | 27 | 50 | 16 | | | 2 | | 2 | 3 | 110 | EPCI | 6.6 | 70 | 8 |
| Example 1-9 | 30 | | | | 50 | 19 | | | 1 | | | | 10 | EPCI | 9.0 | 80 | 112 |
| Comparative Example 1-1 | 30 | | | | 50 | 20 | | | | | | | — | EPCI | 9.5 | 80 | 30 |
| Comparative Example 1-2 | 30 | | | | 50 | 20 | | | | | | | — | EPCI | 9.5 | 80 | 14 |
| Comparative Example 1-3 | 50 | | 25 | | | | | 25 | | | | | — | — | — | 0 | 22 |
| Comparative Example 1-4 | 50 | | 30 | | | | | 20 | | | | | — | EPCI | 3.6 | 30 | 27 |
| Comparative Example 1-5 | 77 | | | | | | | | 10 | | 13 | | — | — | — | — | 15 |

*Ratio of anion equivalent to cation equivalent (percentage); (Anion equivalent/Cation equivalent) × 100

Example 2-1

Using a pulp raw material (LBKP 100%) whose Canadian standard freeness (C.S.F) was adjusted to 400 mL, 1.5% consistency of pulp slurry was prepared and held at 40° C. Subsequently, 0.15% by weight or 0.20% by weight of the internal sizing agent (1) based on the weight of the pulp, and a water-dispersed matter of 30% by weight of calcium carbonate ("TP-121" manufactured by Okutama Kogyo Co., Ltd.) based on the weight of the pulp were sequentially added into the pulp slurry. This slurry was diluted up to 1.0% consistency. Subsequently, the obtained pulp slurry was uniformly stirred, and a wet sheet was produced to have a weighing of 70±1 g/m$^2$ by using a hand sheet former (TAPPI standard sheet machine). This wet sheet was disposed between filter papers and then press-dehydrated under pressure of 5 kg/cm$^2$ for one minute. This was then dried at 105° C. by a rotary drum dryer for 2.5 minutes, resulting in a handsheet.

Examples 2-2 to 2-9

Individual handsheets were obtained through the same procedure as Example 2-1, except that the internal sizing agents (2) to (9) obtained in Examples 1-2 to 1-9 were used, respectively, instead of the internal sizing agent (1) used in Example 2-1.

Comparative Examples 2-1 to 2-5

Individual handsheets were obtained through the same procedure as Example 2-1, except that the internal sizing agents (C1) to (C5) obtained in Comparative Examples 1-1 to 1-5 were used, respectively, instead of the internal sizing agent (1) used in Example 2-1.

Comparative Example 2-6

A handsheet was obtained through the same procedure as Example 2-1, except that a commercially available neutral rosin sizing agent ("Neusize 738" manufactured by Harima Chemicals Inc.) was used instead of the internal sizing agent (1) used in Example 2-1.

Comparative Example 2-7

A handsheet was obtained through the same procedure as Example 2-1, except that a commercially available alkyl ketene dimer (AKD) based sizing agent ("HARSIZE AK-720H" manufactured by Harima Chemicals Inc.) was used instead of the internal sizing agent (1) used in Example 2-1.

The handsheets obtained in Examples 2-1 to 2-9 and Comparative Examples 2-1 to 2-7 were evaluated in terms of sizing performance by the following method. That is, these handsheets were subjected to moisture absorption for 24 hours under conditions of 23° C. and a relative humidity of 50%. Thereafter, their respective Stockigt sizing degrees were measured according to JIS-2-8122. Table 2 shows the results thereof.

TABLE 2

| | Internal sizing agent | | |
|---|---|---|---|
| | Kind | Dosage (% by weight based on pulp) | Stockigt sizing degree (sec.) |
| Example2-1 | Example1-1 (1) | 0.15 | 5.5 |
| | | 0.20 | 12.0 |
| Example2-2 | Example1-2 (2) | 0.15 | 4.5 |
| | | 0.20 | 11.1 |
| Example2-3 | Example1-3 (3) | 0.15 | 4.9 |
| | | 0.20 | 11.4 |
| Example2-4 | Example1-4 (4) | 0.15 | 4.5 |
| | | 0.20 | 11.2 |
| Example2-5 | Example1-5 (5) | 0.15 | 4.3 |
| | | 0.20 | 10.5 |
| Example2-6 | Example1-6 (6) | 0.15 | 5.2 |
| | | 0.20 | 11.6 |

TABLE 2-continued

| | Internal sizing agent | | |
|---|---|---|---|
| | Kind | Dosage (% by weight based on pulp) | Stockigt sizing degree (sec.) |
| Example2-7 | Example1-7 (7) | 0.15 | 5.0 |
| | | 0.20 | 10.8 |
| Example2-8 | Example1-8 (8) | 0.15 | 4.0 |
| | | 0.20 | 9.9 |
| Example2-9 | Example1-9 (9) | 0.15 | 3.9 |
| | | 0.20 | 10.2 |
| Comparative | Comparative | 0.15 | 2.4 |
| Example2-1 | Example1-1 (C1) | 0.20 | 6.8 |
| Comparative | Comparative | 0.15 | 3.1 |
| Example2-2 | Example1-2 (C2) | 0.20 | 8.2 |
| Comparative | Comparative | 0.15 | 1> |
| Example2-3 | Example1-3 (C3) | 0.20 | 1> |
| Comparative | Comparative | 0.15 | 2.0 |
| Example2-4 | Example1-4 (C4) | 0.20 | 3.5 |
| Comparative | Comparative | 0.15 | 1> |
| Example2-5 | Example1-5 (C5) | 0.20 | 1> |
| Comparative | Neutral rosin | 0.15 | 1.8 |
| Example2-6 | sizing agent | 0.20 | 3.2 |
| Comparative | AKD based | 0.15 | 3.6 |
| Example2-7 | sizing agent | 0.20 | 8.9 |

It will be observed from Table 1 and Table 2 that the handsheets of Examples 2-1 to 2-9 produced by using the internal sizing agents (1) to (9) of the invention have higher sizing performance than the that of Comparative Examples 2-1 to 2-5 produced by using the sizing agents for comparison (C1) to (C5), and the that of Comparative Examples 2-6 and 2-7 produced by using the neutral rosin sizing agent and the AKD-based sizing agent, respectively.

More specifically, Examples 2-1 to 2-9 achieved considerable sizing performance improving effect with respect to not only Comparative Example 2-1 using the cationic sizing agent corresponding to the sizing agents of the patent documents 1 to 3, but also Comparative Example 2-2 using the rosin-bonding type cationic copolymer corresponding to the sizing agent described in the patent document 4. It will also be observed from the results of Comparative Examples 2-3 and 2-4 that the sizing performance is remarkably deteriorated in the case of using the cationic sizing agent whose rate of quaternizing is low. It will also be observed that Comparative Example 2-5 using the anionic sizing agent composed of the anionic copolymer exhibited no sizing performance. Although Comparative Examples 2-6 and 2-7 are the cases of using the neutral rosin sizing agent or the AKD-based sizing agent, respectively, it will be observed that Examples 2-1 to 2-9 apparently exhibit high sizing performance with respect to the AKD-based sizing agent of Comparative Example 2-7 which exhibited the highest sizing performance among the comparative examples.

Example 2-8 using the sizing agent, in which the ratio of the anion equivalent to the cation equivalent of the amphoteric copolymer deviated from the suitable range of the invention, had slightly lower sizing performance than other Examples 2-1 to 2-7. The reason for this seems that the anion equivalent is greater than the cation equivalent, and hence the ionic groups within the polymer cause interaction to thereby hinder the effective action of the cationic groups to be self-fixed onto the paper. Similarly, Example 2-9 using the sizing agent in which the weight average molecular weight of the amphoteric copolymer deviates from the suitable range of the invention exhibited slightly lower sizing performance with respect to other Examples 2-1 to 2-7. The reason for this seems that the extremely high molecular weight of the polymer hindered sufficient expansion of the polymer ingredients into the handsheet in the drying process of papermaking.

Example 3

Using a pulp raw material composed of 80% by weight of deinked pulp (DIP) and 20% by weight of thermomechanical pulp (TMP), 3% consistency of pulp slurry was prepared and held at 40° C. Subsequently, 0.15% by weight or 0.30% by weight of the internal sizing agent (1) based on the weight of the pulp, and a water-dispersed matter of 25% by weight of calcium carbonate ("TP-121" manufactured by Okutama Kogyo Co., Ltd.) based on the weight of the pulp were sequentially added into the pulp slurry. This slurry was diluted up to 1.5% consistency. Subsequently, the obtained pulp slurry was uniformly stirred, and a wet sheet was produced to have a weighing of 50±1 g/m$^2$ by using the hand sheet former (TAPPI standard sheet machine). This wet sheet was disposed between filter papers and then press-dehydrated under pressure of 5 kg/cm$^2$ for one minute. This was then dried at 105° C. by a rotary drum dryer for 2.5 minutes, resulting in a handsheet.

Comparative Example 3-1

A handsheet was obtained through the same procedure as Example 3, except that 0.15% by weight or 0.30% by weight of a commercially available neutral rosin sizing agent ("Neusize 738" manufactured by Harima Chemicals Inc.) based on the weight of the pulp was added instead of the internal sizing agent (1) used in Example 3.

Comparative Example 3-2

A handsheet was obtained through the same procedure as Example 3, except that 0.15% by weight or 0.30% by weight of a commercially available alkyl ketene (AKD) based sizing agent ("HARSIZE AK-720H" manufactured by Harima Chemicals Inc.) based on the pulp was added instead of the internal sizing agent (1) used in Example 3.

These handsheets obtained in Example 3 and Comparative Examples 3-1 and 3-2 were evaluated in terms of sizing performance by the following method. That is, these handsheets were subjected to moisture absorption for 24 hours under conditions of 23° C. and a relative humidity of 50%, the water spot size (water-absorbing time) under a dropping water amount of 1 μl or 5 μl was measured according to Japan TAPPI No. 33 (the test method of water absorption rate of absorbable paper). Table 3 shows the results thereof.

TABLE 3

| | Internal sizing agent | | Water spot size | |
|---|---|---|---|---|
| | Kind | Dosage (% by weight based on pulp) | 1 μl (sec.) | 5 μl (sec.) |
| Example3 | Example1-1 | 0.15 | 4 | 16 |
| | (1) | 0.30 | 6 | 24 |
| Comparative | Neutral rosin | 0.15 | 1 | 4 |
| Example3-1 | sizing agent | 0.30 | 1 | 6 |
| Comparative | AKD based | 0.15 | 3 | 9 |
| Example3-2 | sizing agent | 0.30 | 5 | 16 |

It will be observed from Table 3 that under the high blend of the DIP, the handsheet of Example 3 produced by using the internal sizing agent (1) of the invention has higher sizing performance than the handsheets of Comparative Examples 3-1 and 3-2 produced by using the neutral rosin sizing agent and the AKD-based sizing agent, respectively.

While the papermaking internal sizing agents according to the invention and the papers or the paperboards obtained by using these papermaking internal sizing agents according to the invention have been described in detail, the scope of the invention is not restricted by the foregoing descriptions, and suitable changes or improvements may be made therein without departing from the gist of the invention.

The invention claimed is:

1. A papermaking internal sizing agent comprising as an effective ingredient an amphoteric copolymer having hydrophobic groups and cationic groups, at least a part of the cationic groups being quaternized, wherein the amphoteric copolymer is obtained by polymerizing monomer ingredients that essentially contain a hydrophobic monomer (A), a cationic monomer (B), and an anionic monomer (C) and that an anion equivalent of the monomer (C) is 0.1 to 90% of a cation equivalent of the monomer (B), in which a rate of quaternizing of the cationic groups is 40% to 90% by mole, and wherein the cationic monomer (B) is at least one kind selected from the group consisting of a tertiary amino group-containing (meth)acrylamide and a tertiary amino group-containing (meth)acrylate.

2. The papermaking internal sizing agent according to claim 1, wherein the hydrophobic monomer (A) is at least one kind selected from the group consisting of styrenes, and C1 to C14 alkyl esters of (meth)acrylic acid.

3. The papermaking internal sizing agent according to claim 1, wherein the anionic monomer (C) is at least one kind selected from the group consisting of α, β-unsaturated carboxylic acids and α, β-unsaturated sulfonic acids.

4. The papermaking internal sizing agent according to claim 1, wherein the amphoteric copolymer has a weight average molecular weight of 10,000 to 1,000,000.

5. A paper or a paperboard containing the papermaking internal sizing agent according to claim 1.

6. The paper or the paperboard according to claim 5, which is a neutral paper.

7. The papermaking internal sizing agent according to claim 2, wherein the anionic monomer (C) is at least one kind selected from the group consisting of α, β-unsaturated carboxylic acids and α, β-unsaturated sulfonic acids.

8. The papermaking internal sizing agent according to claim 2, wherein the amphoteric copolymer has a weight average molecular weight of 10,000 to 1,000,000.

9. The papermaking internal sizing agent according to claim 3, wherein the amphoteric copolymer has a weight average molecular weight of 10,000 to 1,000,000.

10. The papermaking internal sizing agent according to claim 1, wherein the tertiary amino group-containing (meth) acrylamide is dialkylaminoalkyl(meth)acrylamide.

11. The papermaking internal sizing agent according to claim 1, the tertiary amino group-containing (meth)acrylate is dialkylaminoalkyl(meth)acrylate.

* * * * *